US012442613B2

(12) United States Patent
Eaton

(10) Patent No.: US 12,442,613 B2
(45) Date of Patent: Oct. 14, 2025

(54) COMPENSATOR PARTITION

(71) Applicant: Sig Sauer, Inc., Newington, NH (US)

(72) Inventor: Trevor Eaton, South Hampton, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 18/755,218

(22) Filed: Jun. 26, 2024

(65) Prior Publication Data

US 2025/0003710 A1 Jan. 2, 2025

Related U.S. Application Data

(60) Provisional application No. 63/510,409, filed on Jun. 27, 2023.

(51) Int. Cl.
*F41A 21/36* (2006.01)
*F41A 21/38* (2006.01)
*F41A 29/00* (2006.01)

(52) U.S. Cl.
CPC ..... *F41A 21/38* (2013.01); *F41A 29/00* (2013.01)

(58) Field of Classification Search
CPC ..... F41A 21/34; F41A 21/36; F41A 21/38
See application file for complete search history.

(56) References Cited

U.S. PATENT DOCUMENTS 1,333,402 A * 3/1920 Galliot ..... F41A 21/36 89/14.3
1,948,496 A * 2/1934 Barnes ..... F41A 21/36 89/14.3
2,101,850 A * 12/1937 Green ..... F41A 21/36 89/14.3
2,206,568 A * 7/1940 Hughes ..... F41A 21/36 89/14.3
3,164,060 A * 1/1965 Dahl ..... F41A 21/30 89/14.3
3,776,093 A * 12/1973 Leverance ..... F41A 21/34 89/14.4
4,643,073 A * 2/1987 Johnson ..... F41A 21/36 89/14.3
4,811,648 A * 3/1989 Blackwell ..... F41A 21/36 89/14.3
5,036,747 A * 8/1991 McClain, III ..... F41A 21/36 89/14.3
5,092,223 A * 3/1992 Hudson ..... F41A 21/34 89/14.3
5,357,842 A * 10/1994 Reynolds ..... F41A 21/36 89/14.3
5,698,810 A * 12/1997 Rose ..... F41A 21/32 89/14.3

(Continued)

FOREIGN PATENT DOCUMENTS

WO WO-8602438 A * 4/1986 ..... F41A 21/36

*Primary Examiner* — Derrick R Morgan
(74) *Attorney, Agent, or Firm* — Finch & Maloney PLLC

(57) ABSTRACT

A compensator for a firearm includes a body defining a projectile opening therethrough along a longitudinal axis, where the projectile opening is sized for passage of a projectile fired from the firearm. The compensator includes a removable partition than can be separated from the rest of the compensator to aid in cleaning and servicing. The partition can be replaced without needing to replace the entire compensator.

20 Claims, 4 Drawing Sheets

(56) References Cited

U.S. PATENT DOCUMENTS

| | | | | |
|---|---|---|---|---|
| 6,516,698 | B1 * | 2/2003 | Poff, Jr. | F41A 21/36 89/14.6 |
| 7,059,235 | B2 * | 6/2006 | Hanslick | F41A 21/38 89/14.3 |
| 8,047,115 | B2 * | 11/2011 | Noveske | F41A 21/34 89/14.4 |
| 9,163,892 | B1 * | 10/2015 | Buboltz | F41A 21/28 |
| 9,562,734 | B2 * | 2/2017 | Wilson | F41A 21/38 |
| 10,024,618 | B1 * | 7/2018 | Moore | F41A 21/36 |
| 10,422,603 | B2 * | 9/2019 | Griffitts | F41C 27/22 |
| 10,767,952 | B1 * | 9/2020 | Till | F41A 21/325 |
| 11,512,917 | B2 * | 11/2022 | Turnblom | F41A 21/325 |
| 12,104,870 | B2 * | 10/2024 | Roe | F41A 21/36 |
| 2012/0048100 | A1 * | 3/2012 | Davies | F41A 21/34 89/14.2 |
| 2016/0076844 | A1 * | 3/2016 | Miller, III | F41A 21/30 89/14.3 |
| 2017/0023326 | A1 * | 1/2017 | Wilson | F41A 21/38 |
| 2017/0261282 | A1 * | 9/2017 | Griffitts | F41A 21/36 |
| 2020/0292269 | A1 * | 9/2020 | Guillen | F41A 21/36 |
| 2022/0034620 | A1 * | 2/2022 | Parker | F41A 21/34 |
| 2022/0034622 | A1 * | 2/2022 | Woodman | F41A 21/38 |
| 2023/0272992 | A1 * | 8/2023 | Petersen | F41A 21/36 89/14.3 |
| 2024/0191960 | A1 * | 6/2024 | Toner | F41A 21/36 |
| 2025/0035397 | A1 * | 1/2025 | Olsen | F41A 21/36 |

* cited by examiner

COMPENSATOR PARTITION

FIELD OF THE DISCLOSURE

The present disclosure relates generally to firearm compensators and more specifically to a compensator with a removable partition.

BACKGROUND

A muzzle brake or recoil compensator is a type of muzzle device for a firearm that is designed to reduce muzzle rise or "muzzle flip" by redirecting a portion of propellant gases leaving the barrel. A compensator functions by directing some of the propellant gases upward to counter recoil forces that tend to cause muzzle rise upon firing the gun. Some compensators can be attached to the barrel, such as by threading the device directly onto a threaded handgun barrel or rifle barrel. Other compensators are integral to the barrel, such as when the barrel defines ports to vent gases upward upon firing. A recoil compensator or simply "compensator" may be used on a handgun or long gun with the advantage of enabling the shooter to more quickly realign sights on a target for the next shot.

BRIEF DESCRIPTION OF THE DRAWINGS

In the figures.

Figure 1:
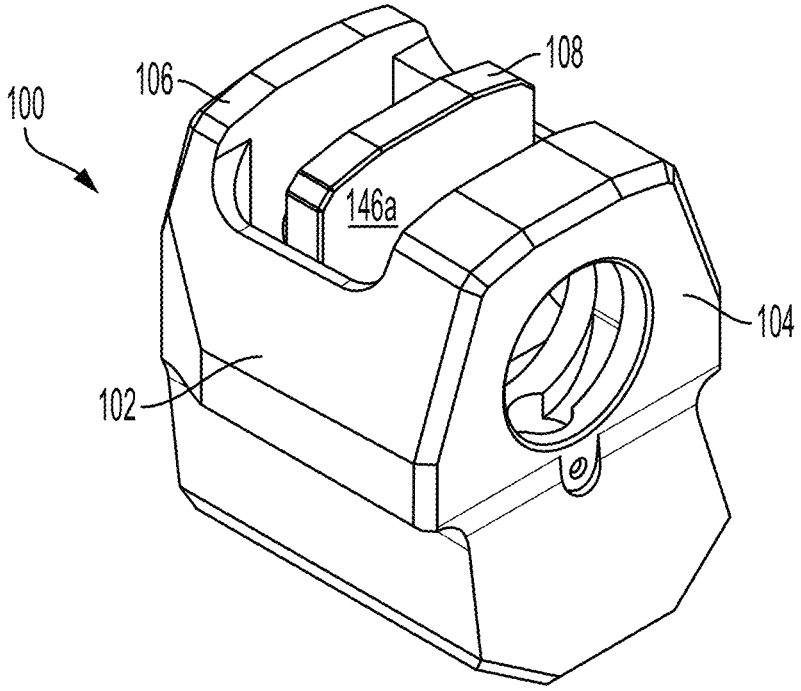
FIG. 1 provides a profile view of one embodiment of a compensator.

The figures depict various embodiments of the present disclosure for purposes of illustration only. Numerous variations, configurations, and other embodiments will be apparent from the following detailed discussion.

DETAILED DESCRIPTION

Disclosed is a multi-part firearm muzzle attachment that includes a removable partition. As used herein, a component is removable if it can be removed and reinstalled by a user by disconnecting and reconnecting a fastener. The muzzle attachment can be a compensator that includes a removable partition that can be taken out and reinstalled by the user of the firearm. This allows for easy cleaning and removal of deposits from the partition and also provides improved access to the interior cavity of the compensator. The partition can be replaced without having to replace the bulk of the compensator and without having to remove the compensator from the muzzle of the firearm. The partition can be held in place with a simple fastener, such as a machine screw.

Overview

After repeated uses, compensators may become fouled with corrosion, carbon deposits, and metals such as lead and copper. The deposits can be difficult to remove, especially from difficult to access portions of the compensator. The compensator described herein includes a removable partition that is positioned in a central portion of the compensator, between proximal and distal portions of the compensator. The user can remove this partition from the compensator without removing the compensator from the muzzle of the firearm. Once removed, the partition can be examined to determine the extent of any deposits or pitting. Deposits can be removed from the partition using solvents, ultrasonic baths and mechanical methods such as scraping, grinding and chipping.

Different sections of a compensator can wear at different rates, and one area subjected to significant wear is the first section of the compensator downstream of the muzzle where the gases have had a chance to expand. This means that a centrally positioned partition, after the muzzle opening, can take the bulk of the wear and tear that the compensator is exposed to. To prolong the life of this wear prone part, the removable partition can be fashioned from a hardened metal, such as stainless steel. The rest of the compensator can be a lighter, softer material, such as aluminum. In this embodiment, the compensator can be light weight due to the extensive use of aluminum but can still exhibit wear resistance due to the harder, removable partition. When a partition does wear out, it can be replaced without replacing the entire compensator. The partition can also be symmetrical, so if it wears more on one surface than the other it can be removed and rotated 180° to subject the previously less worn surface to the most corrosive regions of the compensator.

The removable partition can be held in place with one or more fasteners. For instance, a screw can be passed vertically up through a hole in the base of the compensator to engage threads formed in the removable partition. The partition can include a broad base to provide a stable platform at its interface with the body of the compensator. To provide deflection of gases in an upward direction (to provide downward force) the partition can exhibit different amounts of curvature on the surfaces that are normal to the axis of the firearm. In some embodiments, opposing surfaces of the same partition can exhibit different amounts of curvature so that the user can adjust the effect of the compensator by changing which side of the partition faces the muzzle.

A compensator including a removable partition can be used on a variety of firearms including handguns and long guns in rim fire and center fire configurations.

Example Structures and Methodologies

Figure 2:
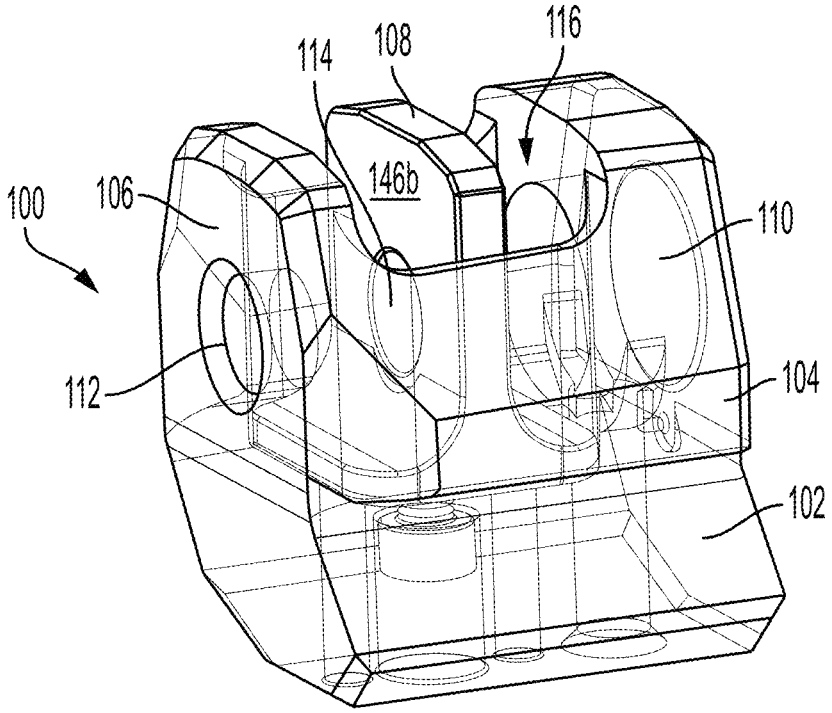
FIG. 2 provides a partially transparent view illustrating the components of the compensator of FIG. 2.

FIGS. 1 and 2 illustrate a profile and a 3-D transparent view of an assembled embodiment of a compensator including a removable partition. Compensator 100 includes body 102 that can be divided into a central portion, proximal portion 104 and distal portion 106. When installed on the muzzle of a firearm, proximal portion 104 is in contact with the muzzle and distal end 106 faces away from the barrel. Removable partition 108 includes proximal surface 146*a*, opposed distal surface 146*b* and bore 114. Proximal portion 104 includes proximal bore 110 and distal portion 106 includes distal bore 112. Bores 110, 112 and 114 may have the same, similar, or different diameters but should all be sized to allow the passage of the projectile that is intended to be delivered by the firearm. The compensator 100 can be secured to the muzzle of the firearm using threads, a set screw or any method that can securely attach the compensator to the barrel. Throughout the description herein, orientations including top, bottom, proximal, distal, forward and rear are to be interpreted to be the orientation corresponding to that when the firearm is held in a standard, horizontal firing position. As shown in FIG. 2, the muzzle of the firearm would be attached to the right side (proximal) of the compensator and the projectile would exit from the left side of the compensator.

Figure 3:
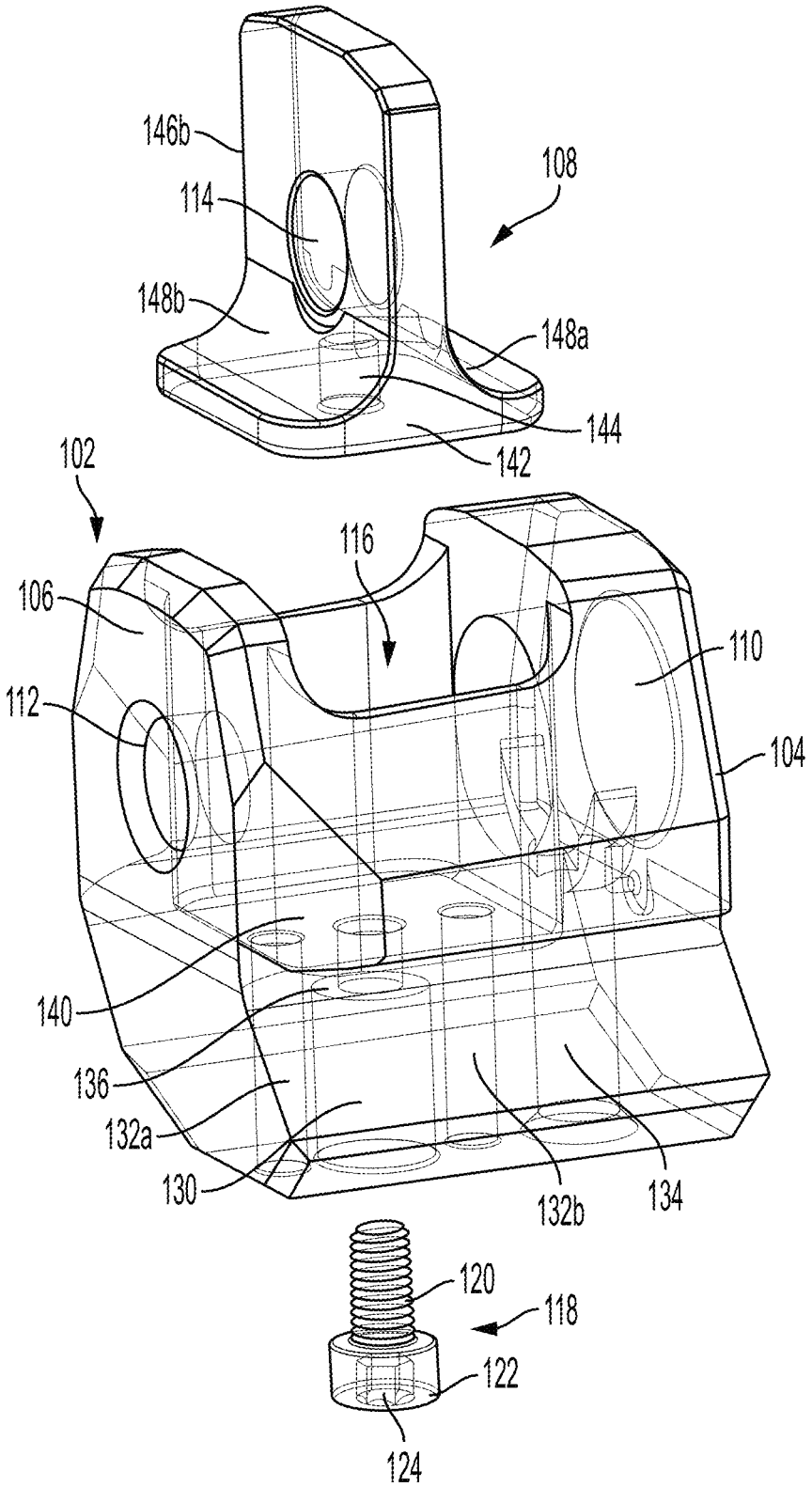
FIG. 3 provides a disassembled view of the embodiment of FIG. 1.
Figure 4:
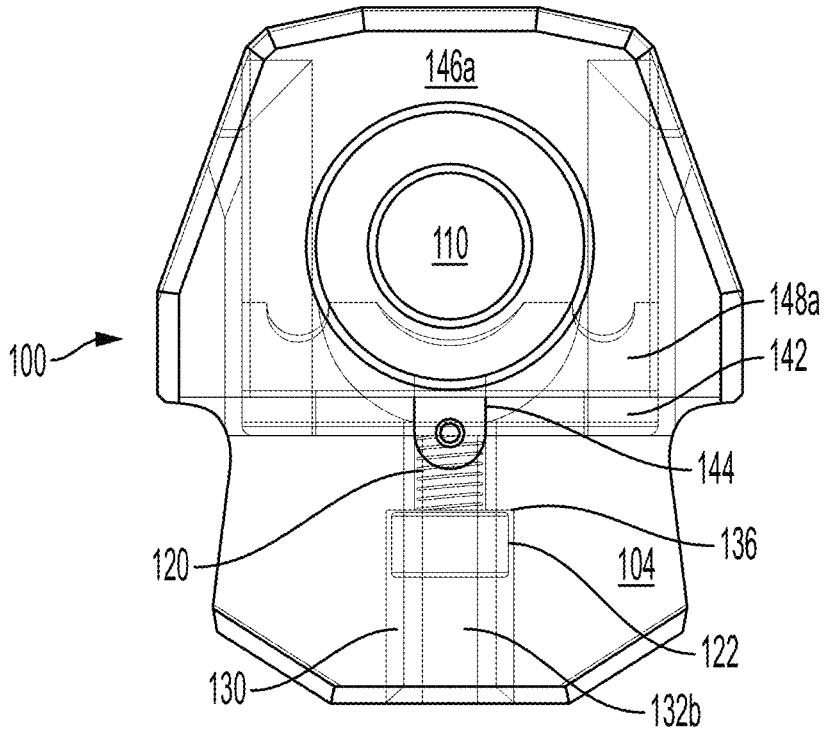
FIG. 4 provides a view from the distal end of the embodiment of FIG. 1.
Figure 5:
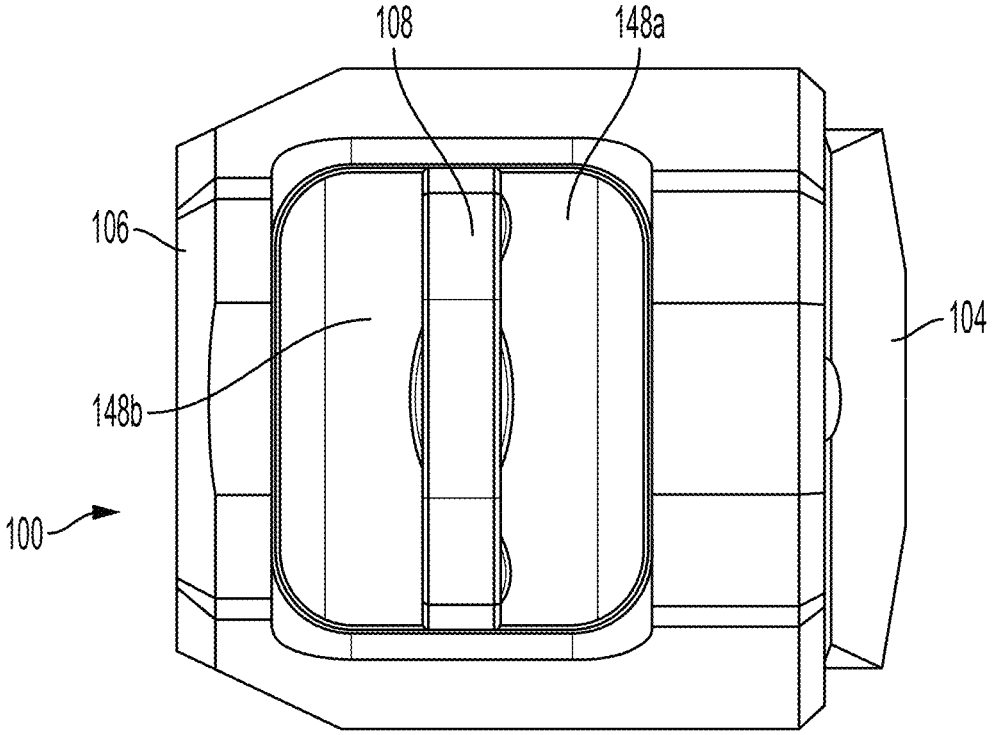
FIG. 5 provides a top down view of an assembled version of the embodiment of FIG. 1.

FIG. 3 illustrates the same embodiment as that shown in FIGS. 1 and 2, but in a disassembled state to reveal more detail of the independent parts. FIGS. 4 and 5 show different views of the same embodiment re-assembled. Removable partition 108 includes substantially planar distal surfaces 146*b* and 146*a*. These surfaces transition to curved concave portions 148*a* and 148*b* in the lower section of the partition. As illustrated, the curvature starts slightly above the lower edge of bore 114. In other embodiments, the curvature can start above the bore, below the bore, or in the middle of the bore. The curvature may be cylindrical or non-cylindrical in curvature and can have a radius of curvature that is greater than 0.5 inch, greater than 1 inch, greater than 2 inch, greater than 5 inch, less than 20 inch, less than 10 inch, less than 5 inch, less than 2 inch or less than 1 inch. As shown, the opposing surfaces of the partition are the same and the partition is symmetrical, meaning that it could be installed with its distal side facing proximally in the body 102. In other embodiments the surfaces are asymmetrical. Fastener receiver 144 is constructed to receive fastener 118. It may be threaded and the threads may be internal threads (female) sized to receive the external threads 120 on screw 118. As shown, fastener receiver 144 is internal to the body of partition 108, but in other embodiments it may extend outwardly from the base to interact with the other portion of a fastener. In some embodiments additional fasteners can be used. For example, two fasteners may be used to secure the partition to the body of the compensator. The fasteners can be aligned with the axis of the firearm, can be aligned across the axis of the firearm or can be in any other appropriate arrangement. Partition base 142 can be dimensioned to mate with indent 140 which is a concave depression in the floor of body cavity 116. The base can be essentially rectangular or square, with rounded corners, as shown. The length and/or width of base 142 can be more or less than the height of the partition, and in some embodiments is less than ¾ or less than ⅔ the height of the partition. In other cases, the base has a length and/or width that is greater than the distance from the bottom of the partition to the bottom of bore 114, greater than the distance from the bottom of the partition to the top of bore 114 or greater than ⅔ the height of partition 108. The bottom and outer walls of base 142 are shaped similarly to the floor and inner walls of indent 140. When mated with indent 140, base 142 secures and supports partition 108. This allows the partition to withstand the forces that it is exposed to during use and also provides feedback to the installer that the partition is in the correct position so that bore 114 is in proper alignment.

Removable partition 108 can be made using methods such as casting, machining or additive manufacturing. It can be composed of a material that can withstand the forces and temperatures that result from the firing of the firearm. These materials include metals such as aluminum and steel. Different types of steel include high carbon steel, alloyed steel, stainless steel and tool steel. In one set of embodiments, the partition is comprised of stainless steel so that it can resist corrosion, pitting and fatigue. As illustrated, the profile of the upper surface of the partition can match that of the proximal and distal portions of the compensator body.

Fastener 118 is designed to pass through cavity 130 and be threaded into fastener receiver 144. Fastener 118 can be of the same or different material than partition 108 and should be of a material that resists galvanic activity with either the partition or the compensator body. In various embodiments, the fastener can be a polymer or a metal. When installed and in tension with receiver 144, fastener 118 secures partition 108 in indent 140 of body 102. In the embodiment shown, cavity 130 is unthreaded and includes shoulder 136 to provide a stopping surface for fastener head 122. Fastener head 122 includes tool interface 124, in this case constructed for receiving a hex key. Additional tools, such as torx wrenches, can be used in various embodiments. As shown, the fastener is a threaded screw oriented vertically. In other embodiments, the fastener can be any device that can removably secure the partition to the compensator body. Fasteners can be horizontally oriented and can be, for example, one or more roll pins or one or more bayonet fittings that are received by a slot in the partition base. In some cases, the tool used to tighten and loosen the fastener can be a hex wrench that is the same size as that used to secure the compensator to the muzzle.

Compensator body 102 can be of a same or different material than partition 108. In some embodiments, body 102 is of a lower density than is partition 108. In some embodiments, the body 102 is anodized aluminum. This material is light and is resilient enough to withstand the temperatures and forces that it is subjected to. It can be, for example, machined, cast or additively manufactured. The body can be a unitary piece or can comprise one or more sections that are held together. It can include an interface for connection to the muzzle of a firearm. This interface can be, for example, internal or external threads and/or a set screw for securing the compensator in position.

Bore 134 provides access for a second fastener that can be used to secure and/or adjust the compensator to the barrel of the firearm. Bores 132*a* and 132*b* extend through the base of body 102 to provide access from below the compensator to central cavity 116. These bores reduce the weight of the compensator and also provide access to the lower surface of partition base 142 when the partition is installed. Due to deposits and/or corrosion, the partition may remain attached to the body 102 even after fastener 122 has been loosened or removed. Bores 132*a* and 132*b* provide access for a punch or other tool that can be used to drive the partition upward, breaking any unwanted bonding points. In various embodiments there can be zero, one, two or more of these access bores.

Figure 6:
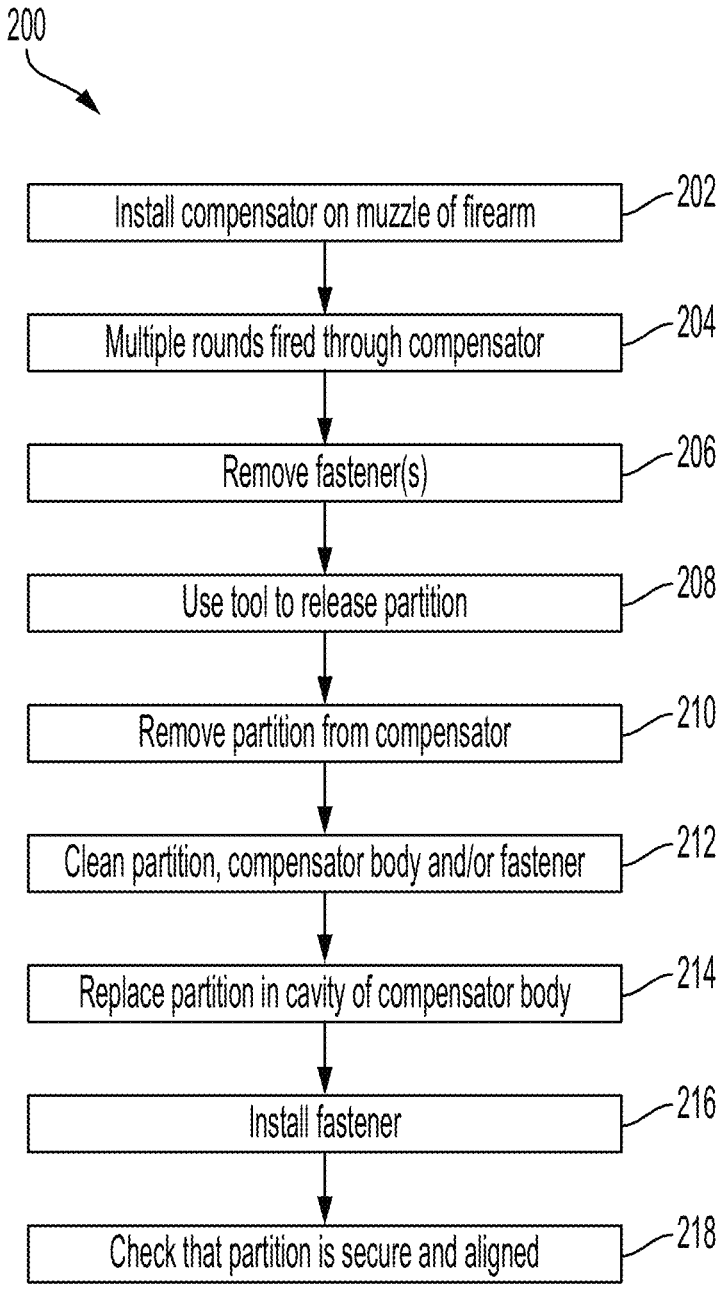
FIG. 6 provides a flow chart outlining a method embodiment disclosed herein.

FIG. 6 provides an embodiment of a method 200 of using the compensator described herein. In 202 the compensator is installed on the firearm. It can be threaded or otherwise securely retained on the muzzle. After using the firearm (204) the user may note deposits or wear on the compensator and/or on the removable partition. Note that the partition can be removed while the compensator is attached to the firearm or after it has been removed from the firearm. The fastener(s) that secures the partition to the body of the compensator can be loosened or removed using a tool such as a hex key. In 208, if necessary, a tool can be used to break any deposits that are preventing the partition from being removed. For instance, a punch can be inserted through an access point to provide a driving force to the bottom of the partition. The partition can then be separated 210 from the body of the compensator. At this point, the partition, the compensator body and/or the fastener can be cleaned. Cleaning 212 can include, for example, treating with a solvent, ultrasonic treatment, or physical removal such as with a wire brush or chisel. The partition can be examined, and the user determine if it needs replacement. If so, the partition can be replaced by a new one without replacement of the entire compensator. In 214, the partition is placed back into the central cavity of the compensator body. It may be replaced in the same orientation as previously, or it can be rotated to expose a different side of the partition to the point of maximum wear and/or deposits. Rotation can be done with partitions that are either symmetrical or asymmetrical. After the partition is seated in the cavity of the body, the fastener can be installed 216. The fastener is tightened 218, optionally to a recommended torque. The user then checks the entire compensator to make sure that parts are aligned and secure 218.

FURTHER EXAMPLE EMBODIMENTS

The following examples pertain to further embodiments, from which numerous permutations and configurations will be apparent.

Example 1 is a compensator for a firearm, the compensator comprising a body having distal and proximal portions defining a central cavity therebetween, the body defining a first bore through the distal portion and a second bore through the proximal portion, the first and second bores sized to allow the passage of a projectile fired from the firearm, the body constructed and arranged to attach to the muzzle of the firearm, a removable partition positioned in the central cavity, the partition including a third bore therethrough, the third bore in alignment with the first and second bores, and a fastener securing the removable partition to the body.

Example 2 is the compensator of Example 1 where the removable partition includes threads for attaching the removable fastener.

Example 3 is the compensator of Example 1 or 2 where the fastener is a single piece.

Example 4 is the compensator of any of claims 1-3 where the fastener is selected from a screw, a roll pin, a keyway and key, a dowel and a bayonet fitting.

Example 5 is the compensator of any of Examples 1~4 where the fastener is limited to a single fastener.

Example 6 is the compensator of any of Examples 1-5 where the partition defines a fastener receiver.

Example 7 is the compensator of any of Examples 1-6 where the fastener receiver comprises internal threads.

Example 8 is the compensator of any of Examples 1-7 where the fastener extends through a bore in the body.

Example 9 is the compensator of any of Examples 1-8 where the fastener is positioned along a vertical axis.

Example 10 is the compensator of any of Examples 1-8 where the fastener is positioned along a horizontal axis.

Example 11 is the compensator of any of Example 10 where the horizontal axis is normal to the axis of the firearm.

Example 12 is the compensator of any of Examples 1-11 where the central cavity is defined by the distal portion, the proximal portion and a floor, the floor including an indent.

Example 13 is the compensator of any of Examples 1-12 where the removable partition includes a base, the base dimensioned to mate with the indent on the floor of the central cavity.

Example 14 is the compensator of any of Examples 1-13 where the fastener is seated in the fastener receiver and the fastener does not extend outwardly from the compensator profile.

Example 15 is the compensator of any of Examples 1-14 where the bottom portion of the body defines an access bore extending through the bottom portion.

Example 16 is the compensator of any of Examples 1-15 where the access bore is oriented vertically.

Example 17 is the compensator of any of Examples 1-16 including a plurality of access bores.

Example 18 is the compensator of any of Examples 1-17 where the removable partition is symmetrical and can be installed in a first position and in a second position rotated 180° from the first position.

Example 19 is the compensator of any of Examples 1-18 where the removable partition includes a planar surface normal to the axis of the firearm and a curved portion constructed and arranged to deflect gases upwardly.

Example 20 is the compensator of Examples 1-19 where the removable partition is comprised of a different material than is the body.

Example 21 is the compensator of any of Example 20 where the removable partition is comprised of a harder material than is the body.

Example 22 is a method of using a compensator with a firearm, the method comprising attaching the compensator to the muzzle of a firearm, disconnecting a fastener holding a partition in the body of the compensator, removing the partition from the body of the compensator, replacing a partition in the body of the compensator, and securing the partition to the body of the compensator by connecting the fastener.

Example 23 is the method of Example 22 including cleaning the partition while it is disconnected from the body of the compensator.

Example 24 is the method of Example 22 where the partition being replaced is the same as the partition being removed.

Example 25 is the method of Example 22 where the partition being replaced is a different partition than the one that was removed.

What is claimed is:

1. A compensator for a firearm, the compensator comprising:

a body having a central cavity defined by a proximal wall and a distal wall, the proximal wall including a first bore and the distal wall including a second bore, the first and second bores defining a common axis and sized to allow the passage of a projectile fired from the firearm, the body constructed and arranged to attach to the muzzle of the firearm;

a removable partition including a third bore, the removable partition positioned in the central cavity, the central cavity constructed and arranged to accept the removable partition via a cavity opening that is transverse to the common axis, and a fastener securing the removable partition to the body.

2. The compensator of claim 1 wherein the removable partition includes threads for attaching the removable fastener.

3. The compensator of claim 1 wherein the fastener is a single piece.

4. The compensator of claim 1 wherein the fastener is selected from a screw, a roll pin, a keyway and key, a dowel, and a bayonet fitting.

5. The compensator of claim 1 wherein the fastener is limited to a single fastener.

6. The compensator of claim 1 wherein the partition defines a fastener receiver.

7. The compensator of claim 6 wherein the fastener receiver comprises internal threads.

8. The compensator of claim 1, wherein the fastener extends through a bore in the body.

9. The compensator of claim 1 wherein the fastener is positioned along a vertical axis.

10. The compensator of claim 1 wherein the fastener is positioned along a horizontal axis.

11. The compensator of claim 10 wherein the horizontal axis is normal to the common axis.

12. The compensator of claim 1 wherein the central cavity is defined by the distal wall, the proximal wall and a floor, the floor including an indent.

13. The compensator of claim 12 wherein the removable partition includes a base, the base dimensioned to mate with the indent on the floor of the central cavity.

14. The compensator of claim 6 wherein the fastener is seated in the fastener receiver and the fastener does not extend outwardly from the compensator profile.

15. The compensator of claim 1 wherein the removable partition is symmetrical and can be installed in a first position and in a second position rotated 180° from the first position.

16. The compensator of claim 1 wherein the removable partition includes a planar surface normal to the axis of the firearm and a curved portion constructed and arranged to deflect gases upwardly.

17. The compensator of claim 1 wherein the removable partition is comprised of a different material than is the body.

18. The compensator of claim 17 wherein the removable partition is comprised of a harder material than is the body.

19. A method of using a compensator with a firearm, the method comprising:

attaching the compensator to the muzzle of a firearm;

disconnecting a fastener holding a partition in the body of the compensator;

removing the partition from the body of the compensator by moving the partition in a direction transverse to a major axis of the firearm;

replacing a partition in the body of the compensator; and securing the partition to the body of the compensator by connecting the fastener.

20. The method of claim 19 comprising cleaning the partition while it is disconnected from the body of the compensator.

* * * * *